United States Patent [19]

Dunstan

[11] Patent Number: 4,846,369

[45] Date of Patent: Jul. 11, 1989

[54] CARTON POURER ATTACHMENT

[76] Inventor: Robert J. Dunstan, 1 Sir Ewen Waterman Avenue, North Haven, South Australia, Australia

[21] Appl. No.: 185,336

[22] Filed: Apr. 21, 1988

Related U.S. Application Data

[63] Continuation-in-part of Ser. No. 6,245, Jan. 8, 1987, abandoned, which is a continuation of Ser. No. 755,674, Jul. 16, 1985, abandoned.

[30] Foreign Application Priority Data

Jul. 25, 1984 [AU] Australia ..... 31179/84
Oct. 12, 1984 [AU] Australia ..... PG7615

[51] Int. Cl.[4] ..... B67B 7/24

[52] U.S. Cl. ..... 222/86; 222/85; 222/478

[56] References Cited

U.S. PATENT DOCUMENTS

| | | | |
|---|---|---|---|
| 1,354,110 | 9/1920 | Kitaoka | 222/85 |
| 1,366,858 | 1/1921 | Anderson et al. | 222/85 |
| 1,954,251 | 4/1934 | Lofgren | 222/85 |
| 2,040,615 | 5/1936 | Lyon | 222/85 |
| 2,544,095 | 3/1951 | Kower | 222/86 |
| 2,556,311 | 6/1951 | Winkler | 222/86 |
| 2,574,989 | 11/1951 | Waite | 222/90 X |
| 2,576,889 | 11/1951 | Partain | 222/86 X |
| 2,777,609 | 1/1957 | Willis | 222/86 |
| 3,929,260 | 12/1975 | Ernst | 222/88 |
| 4,150,768 | 4/1979 | Maynard, Jr. | 222/89 |
| 4,205,757 | 6/1980 | Jurgens | 222/85 X |
| 4,271,983 | 6/1981 | Takemura et al. | 222/86 X |

*Primary Examiner*—Kevin P. Shaver
*Attorney, Agent, or Firm*—Oldham & Oldham Co.

[57] ABSTRACT

A carton pourer attachment for a carton of "gable top" type, which has two conduits, one a breather conduit and a second a pourer conduit that are attached to the top of a common support which has two dependent legs adapted to grip the carton sides during a piercing action; and the pourer conduit has a tongue adapted to push away from a sealing position any tab cut from the top of a carton and also provide an interlocking with a middle lip of the carton to resist removal of the attachment.

15 Claims, 3 Drawing Sheets

CARTON POURER ATTACHMENT

This is a continuation-in-part of co-pending patent application Ser. No. 006,245, filed Jan. 8, 1987, now abandoned, which was a continuation of parent application, Ser. No. 755,674, filed July 16, 1985, now abandoned.

It is now conventional for liquid beverages, especially but not only milk, to be supplied in cartons at the top of which the four sides are joined so that two of the opposite sides rise to a middle lip and the further two opposite sides are folded beneath these first two side portions and then folded back so that there is in fact four thicknesses of carton extending along the middle lip.

Such a pack is sold in Australia under the trade mark "Tetrapak" and is known as a "gable top" carton.

The carton is intended to be opened for pouring of the contents by breaking apart the previously glued together edges on one side of the middle lip.

The technique for achieving this requires some manipulative skill and finger strength and it has been discovered that there are some persons in the community, such as the elderly, the disabled and children, who are unable to provide such skill or have such finger strength.

A problem to which this invention is directed is to propose a means by which a carton of the type described can be made accessible for pouring of the contents with less manipulative skill or finger strength than has been previously required.

It is a further object of this invention to propose means to assist in obtaining access to liquid contents of such cartons which can be economic in manufacture and provide an effective seal upon insertion into the top of the carton against liquid escaping other than through a pouring conduit.

The invention can be said to reside in a carton pourer attachment of a type adapted to pierce the top of a "gable top" type cardboard carton and provide thereby for pouring of liquid contents therethrough from the carton characterised in that the attachment has two downwardly extending legs each located so as to engage respectively against each of two opposite sides of the cardboard carton which legs are appreciably narrower than the sides of the cardboard carton, a cross-portion extending between the two legs, and two downwardly extending conduits supported with respect to the cross-portion, a first of the conduits located closest to a first of the legs, and a second of the conduits located closest to a second of the legs, each of the conduits having a lowermost end of pointed shape adapted to pierce, when pushed thereagainst, the top of a carton of the type described, the legs being each adapted to be located against the sides of the carton and resist protrusion of these during piercing pressure from the conduits against the carton top.

Preferably a first of the conduits is adapted to be a pouring conduit and has at a lowermost end a pointed shape on the side of the conduit wall closest to the closest leg.

Preferably the pouring conduit has at an upper and inner location furtherest from the closest leg, an outwardly extending tongue.

Preferably the tongue is adapted to engage against a lower end of the middle lip of a pierced carton and provide an interlocking retention of the attachment thereby.

Preferably the lower edge of the pouring conduit is sharpened.

Preferably the cross-portion has a shape including a middle 'U' shape adapted to encompass the middle lip of the said carton.

Preferably the lower portion of the pouring conduit is shaped so as to have an outer wall which is of 'U' shape in cross-section with the open mouth of the 'U' shape furtherest from the closest leg and the wall shape increasing in cross-sectional area as the measurement rises from a lowermost end up to a cross-portion interconnection.

Preferably the extent of taper effected by such increase in cross-sectional size provides between opposite outer faces an included angle of approximately 30°.

Preferably the legs are joined with the cross-portion in such a way as to allow a resilient pushing apart of the lower end of the legs one with respect to the other, and preferably this is to the extent of approximately one kilogram pressure against the sides of a carton when being pierced.

Preferably the carton pourer attachment is made from molded plastic such as polyehtylene or polypropylene.

Further features of the invention will be appreciated by reference to the accompanying claims and by reference to the preferred embodiment which shall now be described with the assistance of drawings in which:

Figure 1:
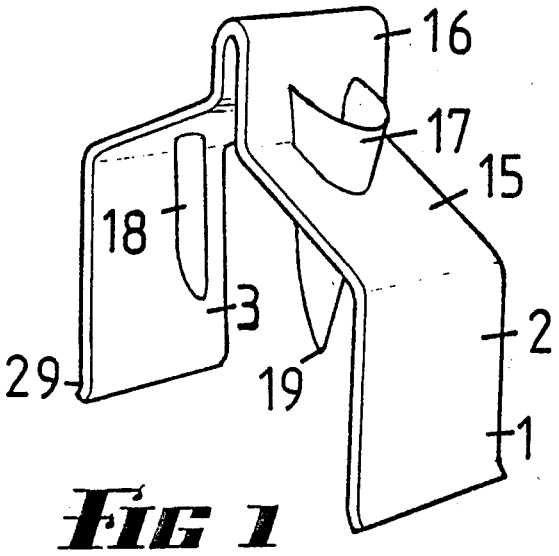
FIG. 1 is a perspective view of a carton pourer attachment according to the preferred embodiment.

Referring in detail to the drawings, the article is manufactured from injection moulded plastic appropriate for food applications, and styrene acrili nitrile (S.A.N.) has been selected to provide both resilient interconnection of the parts and food grade handling.

Accordingly, the attachment 1 has two downwardly extending legs 2 and 3 each adapted to be located on the opposite sides of a carton 4, the carton being of a type as previously described as a "gable top".

The carton 4 has two oppositely located sides 5 and 6 which are bent inwardly and then back outwardly at 7 and 8 on one side to join with the two remaining opposite sides 9 and 10 which rise at an incline to a commonly connected middle lip 11.

There are accordingly four thicknesses of cardboard along the middle lip 11, two of these extending to halfway along position from an end 12 to a middle position of the middle lip 11.

In a conventional opening technique, the four thicknesses at one end such as end 12 of the middle lip 11, are separated with two being pulled apart to one side from two to the other side and it is then necessary to bend the wings so as to bend back into an opening spout shape the side 5.

Figure 5:
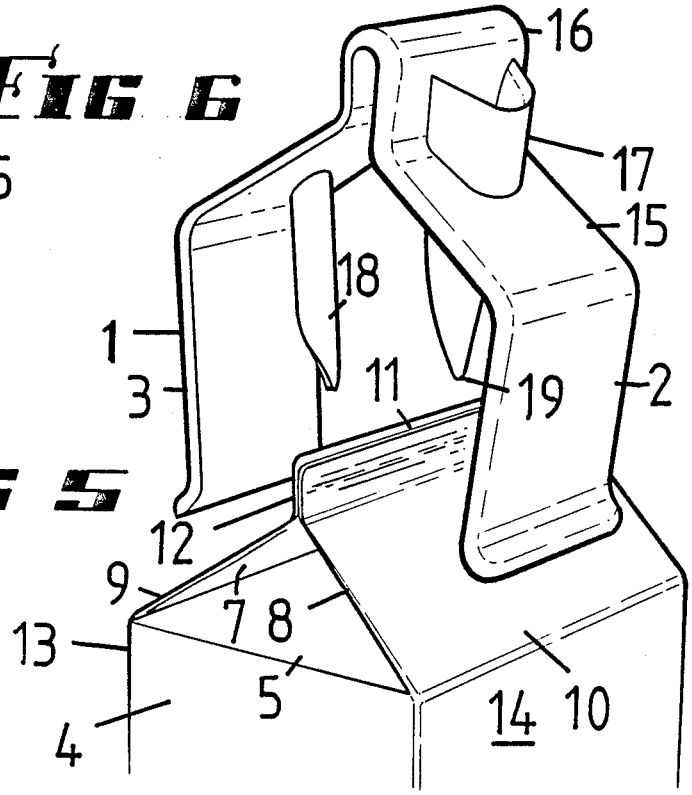
FIG. 5 shows a perspective view of the carton pourer attachment in its preliminary position about to introduce from above onto a "gable top" type carton which is also shown in perspective outline.

The carton pourer attachment 1 does not involve such manipulation but requires the insertion from above of the attachment 1 from a position as shown in FIG. 5, in which the legs 2 and 3 at first narrower than the distance apart of sides 13 and 14 are splayed under resilient pressure by reason of the shape and characteristics of the material from which the attachment 1 is made and including a cross-portion 15 which includes a portion 16 which defines a 'U' shape gap adapted to encompass over and around the middle lip 11.

The legs 2 and 3 are resiliently positioned and are narrower than the width of the sides of the carton to facilitate obtaining good engagement of the legs with the carton when the carton pourer attachment is initially being engaged with the carton.

There are two conduits 17 and 18, the first of these 17, being a pouring conduit and the second 18, being a breather conduit.

The pouring conduit is located on one side of the cross-portion so that its position is closest to its closest leg 2 and the breathing conduit 18 is positioned so as to be closest to its closest leg 3.

Referring in detail to the pouring conduit 17, this includes a lowermost pointed end 19 which is on a side of the conduit wall closest to its closest leg 2 and the cross-sectional shape of the pouring conduit 17 below the cross-portion 15 is of 'U' shape with the open end of the 'U' furtherest from the closest leg 2.

Figure 7:
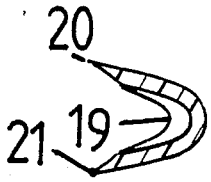
FIG. 7 is a cross-sectional view along the lines 7—7 as shown in FIG. 4.

The outermost edge of each side of the 'U' shape shown most clearly at FIG. 7 is sharpened this being shown at both 20 and 21. This is intended to have the effect of assisting of cutting a tap 22 from the carton top side portion 10 as the conduit 17 enters through this.

Tongue 23 is located between the sharpened ends of the 'U' shape of the lower end of the conduit 17 there being a gap between the respective sharpened ends 20 and 21 and tongue 23, the tongue protruding out from the alignment 24 as is shown at 25 so as to effectively push away from sealing engagement the tab 22.

Figure 4:
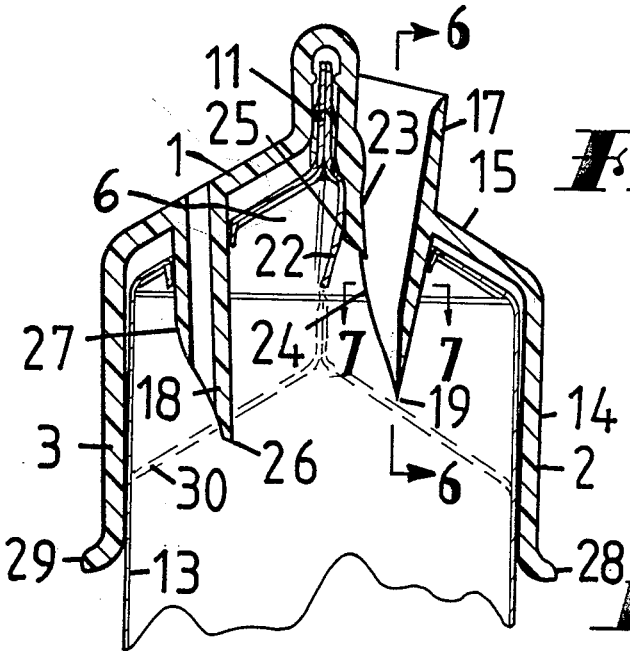
FIG. 4 is a cross-sectional view of the same embodiment as in FIGS. 1, 2 and 3 showing in more detail the view as is shown in FIG. 2.

The shape of the tongue 23 furthermore, together with its position, is such that the pressure of the tongue at 25 against the tab 22, and also against the pressure of four layers of the middle lip 11, provides an interlocking engagement effect assisting in retaining the attachment 1 in the position as shown in FIG. 4.

The breather conduit 18 has a sharpened lowermost end at a position in the wall furtherest from its closest leg 3 at 26 and the shape of the lowermost end with the opening is then tapered so as to provide an increase in cross-sectional area as the location of measurement is raised until at about 27 the cross-sectional shape reaches a maximum and is kept at a constant diametrical shape and diameter for the remainder of the length of the conduit up and until it reaches the cross-portion 15.

There is a relationship between the location of the lowermost ends 19 of pouring conduit 17 and lowermost end 26 of breathing conduit 18 with the lowermost ends of corresponding legs 2 and 3 at 28 and 29 so that upon a downward pushing action, as is shown especially in FIG. 4 with respect to the dotted outline of the carton at 30, the leg portion at 29 is pressing the side of the carton 13 with about one kilogram of force as the end 26 starts to push into the side 9 and likewise the sharpened end 19 is just entering the top side portion 10 as the end 28 is bracing the side 14.

In this way it can be made more effective to achieve a piercing by the respective conduit ends without undue crumpling of the carton materials.

Figure 6:
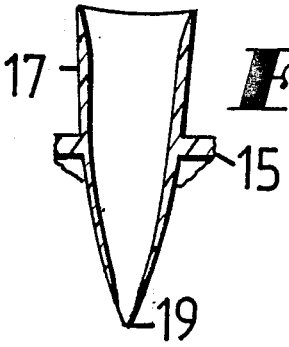
FIG. 6 is a cross-sectional view along the lines 6—6 as shown in FIG. 4.

The angular relationship of the sides defining the outer face of the lower part of the pouring conduit 17 are tapered especially as is shown in FIG. 6 so that there is an approximate increasing cross-sectional area as the point of measurement is raised and the angular relationship of the two sides is very approximately 30°.

Some experimentation is necessary to achieve a base tapering angle depending upon the thickness of a carton wall size, the sharpness achievable in relation to the edges and bottom of the respective conduits, and the surface finish of the outer wall of the conduits in order to provide adequate sealing for the purpose intended.

In use, the attachment 1 is located firstly in a position as is shown in FIG. 5, then with both hands, with at least one finger beneath each end of the middle lip 11, and both thumbs above the center of the attachment 1, the attachment is pushed downwardly with a squeezing action whereupon the legs will splay so as to ride against the outside of the respective sides, and with continual squeezing action by such manual insertion, the respective conduits 17 and 18 can be caused to pierce through the top side portions 9 and 10 and the attachment 1 must then be inserted so as to be fully pushed until the position as shown in FIG. 4 is reached.

Figure 2:
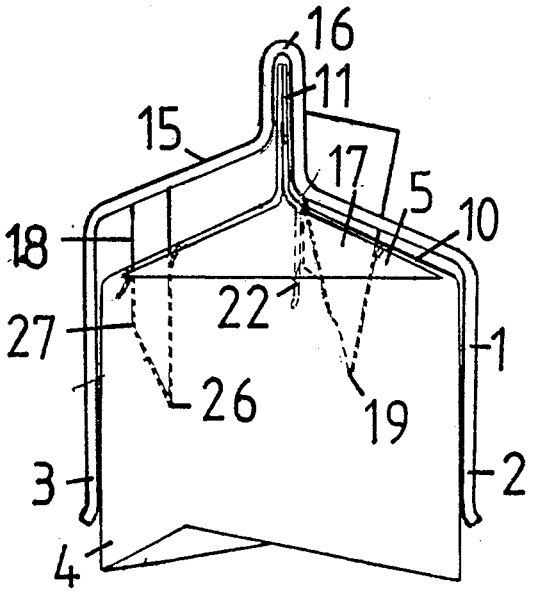
FIG. 2 is a side elevation of the same embodiment as in FIG. 1 viewed from the side when in a pouring position in a "gable top" carton with parts of the several conduits and torn tabs from the carton shown in dotted outline.
Figure 3:
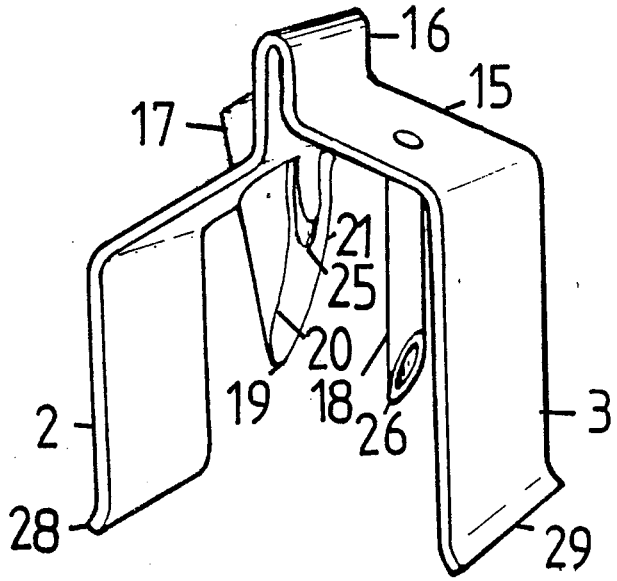
FIG. 3 is the same embodiment as in FIGS. 1 and 2 the view being a perspective view from the opposite position to that illustrated in FIG. 1.

To be used for pouring, the arrangement as in both FIGS. 2 and 4 illustrates the carton with the pourer attachment and the carton is simply turned to the side with the pouring conduit lowermost. Air passes into the uppermost level of the carton through the breath 4 conduit to replace exiting fluid.

As the contents of the carton diminish, the turning of the carton will have to be more and at the last, a full turning of the carton to fully upside down will allow effective removal to a very small remaining liquid content through a gap existing between the tab 22, the tongue 23 and the edge either 20 or 21 of the pouring conduit 17.

The legs 2 and 3 are spaced at their free ends a shorter distance than the width of the carton 4, and they extend as resilient cantilevers from the cross-portion 15, to aid the attachment in obtaining good reinforcing engagement with opposite sides of the carton.

The invention provides a significant improvement in the art.

The claims defining the invention are as follows:

1. A pouring attachment for a gabletop-type cardboard carton, the carton having four sides, a bottom, and an apex at its upper end having an upwardly extending middle lip; the attachment comprising: a cross-portion having a centrally disposed inverted U-shaped portion which encompasses said middle lip of said carton when said attachment is attached thereto; the cross-portion further comprising two outwardly and downwardly extending angled portions depending from opposite ends of said U-shaped portion respectively; two downwardly extending resilient, converging legs depending from an outer end of said angled portions respectively, for engaging opposite sides of said carton to retain the attachment on said carton, said legs having a width smaller than the width of the carton side walls; a pouring conduit on one of said angled portions adjacent to said U-shaped portion extending above said angled portion and having a portion of said U-shaped portion defining a wall of said pouring conduit, a venting conduit on said other one of said angled portions; both of said conduits depending downwardly from said respective angled portion and having a pointed shape for piercing the top of the carton, said pouring conduit having an inlet aperture which faces the venting conduit and extends upwardly to the respective angled portion to permit complete draining from the carton when inverted; and said venting conduit extending further downwardly than the pouring conduit for piercing the carton before the pouring conduit pierces the carton during attachment of the attachment to the carton.

2. The pouring attachment according to claim 1, wherein one of said angled portions is disposed lower than the other one of said angled portions.

3. The pouring attachment according to claim 1, wherein said venting conduit has an aperture that faces away from said pouring conduit.

4. The pouring attachment according to claim 1, wherein said attachment is made of plastic.

5. The pouring attachment according to claim 1, wherein said venting conduit has a diameter smaller than the pouring conduit.

6. The pouring attachment according to claim 1, further comprising a tongue located at the top of the inlet aperture of said pouring conduit and extending downwardly from the angled portion having the pouring conduit, wherein said tongue pushes a tab of the carton away from the inlet aperture of the pouring conduit which has been cut by the pointed shape of the pouring conduit during attachment of the pouring attachment to the carton.

7. The pouring attachment according to claim 1, wherein the pointed shape of the pouring and venting conduits is defined by a tapering of the conduits.

8. The pouring attachment according to claim 1, wherein the pouring conduit has a generally U-shaped cross-section.

9. The pouring attachment according to claim 1, wherein the lower ends of the legs are outwardly flared.

10. The pouring attachment according to claim 1, wherein the two downwardly extending resilient converging legs have a lower portion spaced apart from one another which is less than the width of the carton.

11. The pouring attachment according to claim 1, wherein the venting conduit is centrally located in its respective angled portion such that it pierces the approximate center of one side of the top of the gable-top of the carton.

12. The pouring attachment according to claim 1, wherein said legs extend as cantilevers from said angled portions, and said legs exert approximately one kilogram of pressure against the respective sides of the carton when the pouring attachment is attached thereto.

13. The pouring attachment according to claim 1, wherein said legs allow a resilient pushing apart of the lower ends of the legs with respect to one another.

14. The pouring attachment according to claim 1, wherein said legs resist protrusion of said opposite sides of said carton during attachment of said pouring attachment to said carton.

15. The pouring attachment according to claim 1, wherein said pouring conduit increases in cross-sectional area from a lowermost end to an upper portion thereof.

* * * * *